United States Patent [19]

Montigny

[11] 4,008,973

[45] Feb. 22, 1977

[54] REFLECTIVE PAVEMENT MARKER

[76] Inventor: Joseph W. Montigny, 2441 Merced, South El Monte, Calif. 91733

[22] Filed: Sept. 10, 1975

[21] Appl. No.: 611,983

[52] U.S. Cl. ..... 404/16
[51] Int. Cl.[2] ..... E01F 9/04
[58] Field of Search ..... 404/16, 15, 12, 9

[56] References Cited

UNITED STATES PATENTS

| | | | |
|---|---|---|---|
| 1,927,757 | 9/1933 | Ross | 404/16 |
| 2,065,314 | 12/1936 | Johnson | 404/16 |
| 2,169,674 | 8/1939 | Adas | 404/16 |
| 2,192,878 | 3/1940 | Beebe | 404/16 X |
| 2,245,336 | 6/1941 | Hamilton | 404/16 |
| 2,337,793 | 12/1943 | Abbott | 404/16 |
| 3,277,800 | 10/1966 | Wiswell | 404/16 |

*Primary Examiner*—Nile C. Byers, Jr.
*Attorney, Agent, or Firm*—Boniard I. Brown

[57] ABSTRACT

A reflective pavement marker in the form of a marker button, such as a ceramic button, to be secured to a vehicle roadway with a given normally horizontal axis of the button aligned lengthwise of the roadway and having one or more reflectors each facing in one direction along the axis for reflecting light from the headlights of an approaching vehicle back toward the vehicle. Each reflector is recessed into the upper surface of the marker button in a manner such that vehicle wheels roll over the button without contacting and thereby optically degrading the reflector. Each reflector recess is bounded by an endwall facing along the button axis and mounting the reflector and a sidewall facing laterally of the axis, which walls extend to the outer perimeter of the button, whereby each recess has but a single interior corner and is open along the button perimeter between the walls to reduce the tendency of debris to collect in the recess and permit blowing of debris from the recess by the airstream of passing vehicles.

8 Claims, 5 Drawing Figures

FIG. 1.
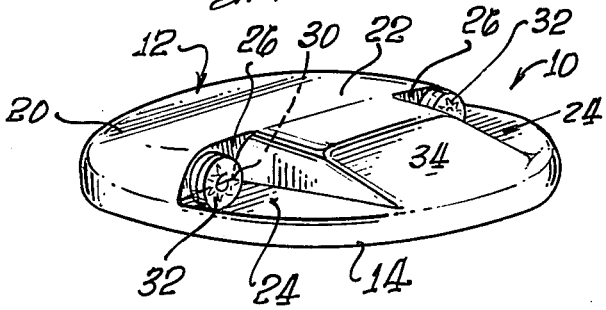
FIG. 2.
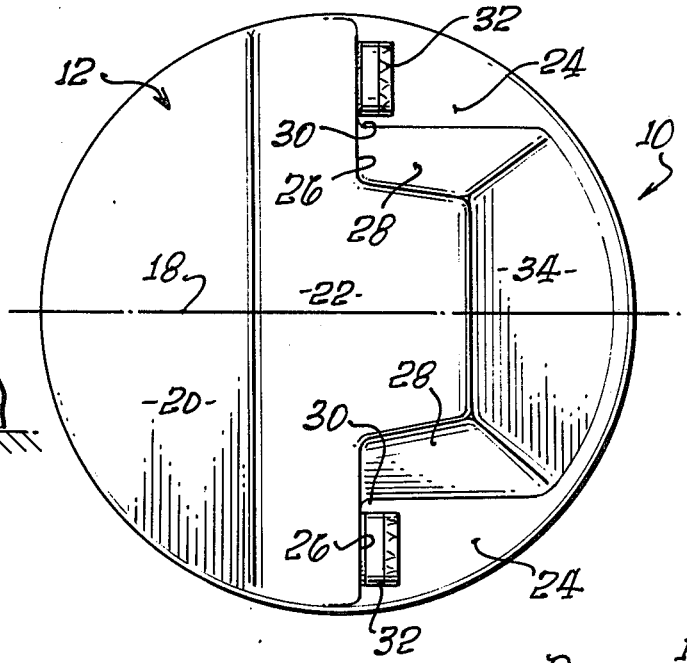
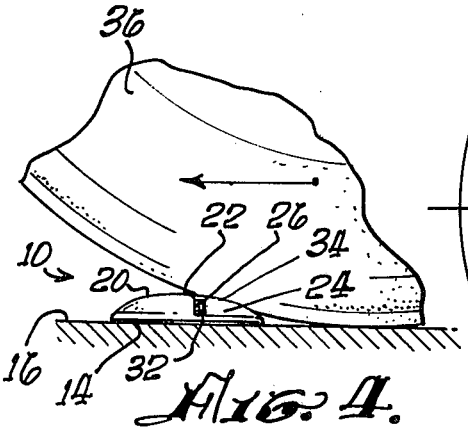
FIG. 4.
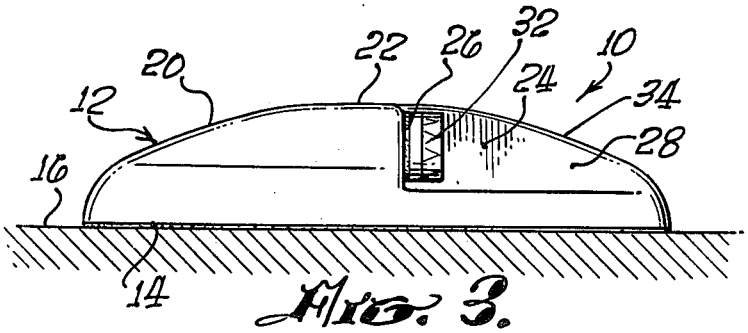
FIG. 3.
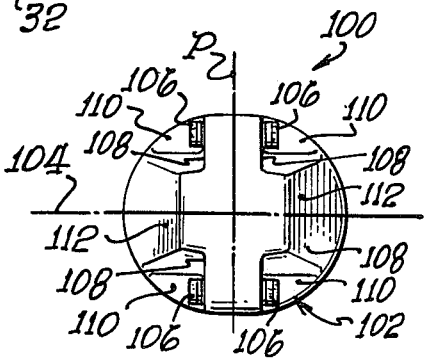
FIG. 5.

REFLECTIVE PAVEMENT MARKER

BACKGROUND OF THE INVENTION

1. Field of the Invention

This invention relates generally to vehicle driving aids and more particularly to an improved reflective pavement marker for vehicle roadways and the like.

2. Discussion of the Prior Art

Motor vehicle roadways, such as highways, freeways, and surface streets are commonly provided with traffic lanes defined by some type of readily visible lane defining or dividing means. In some cases, simple painted lines are used. Most frequently on major roadways reflective pavement markers are used because of their superior visibility, particularly at night, and their ability to alert a dozing driver by virtue of the sound and vibration produced upon passage of vehicle wheels across the markers. This invention is concerned with such pavement markers.

In essence, a reflective pavement marker comprises a generally flat and relatively thin marker body, referred to herein as a marker button, to be bonded or otherwise secured to a vehicle roadway and light reflectors or other light reflective means on the button for reflecting light from the headlights of approaching vehicles back toward the vehicles. A vast assortment of such pavement markers have been devised. Of interest in this regard are U.S. Pat. Nos. 1,906,655 and 3,332,327.

Reflective pavement markers of this kind present two major problems to which the present invention is addressed. One of these problems resides in the fact that many of the light reflectors used on such markers are prone to rapid physical and/or optical degradation, and hence loss of their light reflecting capability, by repeated contact by the wheels of passing vehicles.

One prior art solution to this problem involves the use of light reflectors which are specially designed to withstand such wheel contact without damage or appreciable optical degradation or which are effectively self cleaning by the action of passing vehicles. Such reflectors, however, tend to be quite complex and costly and thus are ill-suited to use in pavement markers from the standpoint of cost effectiveness. According to another prior art solution to the problem which avoids the above disadvantages of complexity and cost, the reflectors are recessed into the marker button in such a way that vehicle wheels roll over the button without contacting the reflectors. This latter solution, however, gives rise to the second problem referred to above.

Thus, the reflector recesses of the existing recessed reflector type pavement marker are essentially channels which are open only at one end, that is the end facing the approaching vehicle traffic, and which are bounded at their opposite end by an end wall mounting a reflector and along their sides by side walls extending from the end wall to the perimeter of the marker button. Such an essentially closed channel-like recess has two interior corners and tends to collect dirt and other debris which soon covers and obscures the reflector and thus greatly reduces the night-time effectiveness of the marker. Moreover, the drafts created by passing vehicles are not effective to blow such debris from the recess, nor is rain effective to wash away the debris.

SUMMARY OF THE INVENTION

This invention provides improved recessed reflector type pavement markers which avoid the foregoing disadvantage of the existing markers of this kind. In essence, the improved pavement markers are characterized by reflector recesses which have but a single interior corner and open both in the direction of the approaching traffic and laterally of such direction. As a consequence, the tendency for dirt and other debris to collect in the recesses is greatly reduced, and the recesses are effectively self-cleaning under the action of rain, wind, and the drafts created by passing vehicles.

Two embodiments of the invention are described, each having a marker button to be secured to a vehicle roadway with a given normally horizontal axis of the button aligned lengthwise of the roadway. The button may be constructed of any suitable material capable of withstanding the wear and tear of vehicle traffic but is preferably molded from a ceramic material of the kind used for some types of pavement markers. Each described marker has a pair of reflectors recessed into the upper surface of the marker button at opposite sides of the button axis and facing in one longitudinal direction of this axis to reflect light from the headlights of approaching vehicles. The button recesses are spaced laterally of the axis to form between the recesses a ramp-like portion over which vehicle wheels may roll without contacting the recessed reflectors.

Each reflector recess is bounded by an endwwall facing along the button axis and mounting the corresponding reflector and a side wall along and facing away from the ramp. These walls join at their inner ends to form the single interior corner of the recess and extend outwardly to the button perimeter. Accordingly, each recess is open along the button perimeter between the end and side walls to achieve the self-cleaning action of the recess mentioned above.

One described pavement marker is designed for use on one way traffic roads and has but a single pair of recessed reflectors facing in one direction along the marker button axis. The other described marker has two pairs of recessed reflectors which face in opposite directions along the axis and is designed for use on two-way traffic roads.

BRIEF DESCRIPTION OF THE DRAWINGS

FIG. 1 is a perspective view of a one way traffic reflective pavement marker according to the invention;

FIG. 2 is an enlarged top view of the marker;

FIG. 3 is a side elevation of the marker;

FIG. 4 is a view similar to FIG. 3 in reduced scale illustrating the manner in which a vehicle wheel rolls across the marker without contacting its recessed reflectors; and FIG. 5 is a top plan view of a two way traffic pavement marker according to the invention.

DESCRIPTION OF THE PREFERRED EMBODIMENT

Referring first to FIGS. 1–4, the illustrated pavement marker 10 comprises a marker button 12 which may be constructed of the ceramic material mentioned earlier. The illustrated marker button has a generally flat and relatively thin disc shape which is the preferred button shape. This disc shape is not critical to the invention, however, so that other button shapes may be utilized within the scope of the invention. The marker button may be rectangular or polygonal, for example.

Marker button 12 has a flat bottom surface 14 to be adhesively bonded or otherwise secured to a roadway 16 with a given edgewise and hence normally horizontal axis 18 of the button aligned lengthwise of the roadway. In the particular pavement marker shown, axis 18 coincides with a centerline, i.e., a diameter, of the marker button 12. The marker button has a convex upper surface 20 which provides a crest 22 at the center of the button and slopes downwardly toward the edge or perimeter of the button.

Entering the upper button surface 20 at opposite sides of the axis 18 are a pair of recesses 24. Each recess is bounded by an end wall 26 and a side wall 28. End wall 26 faces in one longitudinal direction of the axis. Side wall 28 faces laterally of and away from the axis. The two end walls 24 are located substantially in a common transverse plane of the axis passing approximately through the center of the marker button.

The inner ends of the walls, 26, 28 of each recess 24 meet to form an interior corner 30 of the recess. The walls extend outwardly from this corner to the edge or perimeter of the marker button 12. As a consequence, each recess is open along the perimeter of the button between the walls, that is between the outer ends of the walls. Stated another way, each recess opens edgewise of the marker button in both longitudinal and lateral directions of the axis 18.

Mounted on the recess end walls 26 are light reflectors 32. Insofar as the present invention is concerned, any type of light reflectors may be used. The particular reflectors shown, which are the preferred reflectors, are small cylindrical button-like reflectors marketed by Rupert Manufacturing Co. and Stimsonite Co. These reflectors are adhesively bonded or otherwise secured to the end walls and face in the same longitudinal direction of the axis 18 as the end walls to reflect light from the head lights of approaching vehicles.

The side walls 28 of the reflector recesses 24 are spaced laterally of the axis 18 to form between the recesses a ramp 34. This ramp extends from the front edge or perimeter of the marker button 12 to the crest 22 of the button. Because of the convex contour of the upper button surface 20, the ramp slopes upwardly from the perimeter to the crest. The inner or rear end of the ramp rises to a level, opposite the recess end walls 26, higher than the reflectors 32 and then continues in the rear portion of the button surface 20 which slopes downwardly to the rear edge or perimeter of the button. The recess side walls 28, which form the sides of the ramp 34, are preferably tapered or rounded to converge in the upward direction, as shown.

As noted earlier, one important feature of the invention resides in the fact that vehicle wheels ride over the marker button 12 without contacting and thereby degrading the reflectors 32. In this regard attention is directed to FIG. 4 in which it will be seen that when a vehicle wheel 36 rides over the button, it rolls upwardly along the ramp and then downwardly along the rear side of the button without contacting the reflectors. As a consequence, the reflectors are not optically degraded by vehicle traffic as happens with many conventional pavement markers having flush mounted, i.e., non-recessed, reflectors.

Another important feature of the invention resides in the laterally opening, single interior corner configuration of the reflector recesses 24. Because of this configuration, the tendency for dirt and other debris to collect in the recesses, and thereby cover and obscure the reflector 32, is substantially reduced. Moreover, the recesses are effectively self-cleaning under the action of wind, rain, and the air streams created by passing vehicles which tend to blow or wash debris from the recesses. For example, vehicle wheels passing over the marker button in the manner shown in FIG. 4 create air streams which tend to blow debris laterally through the open sides of the reflector recesses. This is in complete contrast to the existing recessed reflector-type pavement markers whose reflector recesses are closed along both sides and open only forwardly in the direction of approaching traffic. In this type of marker, a vehicle wheel riding over the marker actually seals off the open front end of the recess when the wheel first contacts the marker, thus trapping debris in the recess and driving the debris to the closed rear end of the recess where it covers and obscures the reflector.

The pavement marker of FIGS. 1–4 is designed for use on one way traffic roadways which require vehicle head light reflection in one direction only. The reflective modified pavement marker 100 of FIG. 5 is designed for use on two way traffic roadways. This modified marker is symmetrical about a plane P passing through the center of the marker button 102 normal to the marker button axis 104 which is aligned lengthwise of the roadway. At each side of this plane are a pair of reflectors 106 mounted on the end walls 108 of recesses 110 which define an intervening ramp 112 and open longitudinally and laterally of the ramp in the same manner as in the pavement marker of FIGS. 1–4. This modified pavement marker thus has all the advantages of the marker of FIGS. 1–4 and the additional advantage of two way head light reflection, that is the ability to reflect light from the head lights of vehicles approaching the marker from either direction.

The inventor claims:

1. A reflective pavement marker comprising:

a generally flat and relatively thin marker button to be secured to a vehicle roadway with a given edgewise axis of the button aligned lengthwise of the roadway, said button having a pair of recesses entering its upper surface at opposite sides of said axis, each recess having a substantially flat end wall substantially midway of the length of the marker and facing in one endwise direction of said axis, and having an inclined side wall extending laterally of and away from said axis, said inclined recess side walls being oppositely spaced laterally of said axis to define a wide load-bearing ramp extending from said recess end walls to the perimeter of said button, said walls of each recess intersecting to define a single interior corner of the recess and extending outwardly from said corner to the perimeter of said button to define an open recess extending along said button perimeter between the outer ends of said walls, the recess opening in both said one endwise direction of said axis and laterally of said axis, said recess thus defined maintaining itself clean and debris-free under the action of vehicle air-streams, wind and rain, light reflectors mounted in said recess end walls for reflecting light from head lights of approaching vehicles, and said ramp rising above said reflectors, whereby vehicle wheeled tires rolling over said pavement marker ride along said ramp to the crest substantially midway of the button without contacting said reflectors.

2. A pavement marker according to claim 1 wherein: said ramp slopes downwardly in said direction along the axis.

3. A pavement marker according to claim 2 wherein: said marker button has a disc shape and a convex upper surface with a crest at the center of the button.

4. A pavement marker according to claim 3 wherein: said reflectors comprise circular reflector buttons secured to said recess end walls.

5. A reflective pavement marker comprising:

a generally flat and relatively thin marker button to be secured to a vehicle roadway with a given edgewise axis of the button aligned lengthwise of the roadway, said button having a pair of recesses entering its upper surface at each side of a plane normal to said axis and bisecting the button, the two recesses of each recess pair being located at opposite sides of said axis and each recess having a substantially flat end wall substantially midway of the length of the marker and facing in one endwise direction of said axis and away from said plane and having an inclined side wall extending laterally of and away from said axis, said inclined side walls of each recess pair being oppositely spaced laterally of said axis to define a wide load-bearing ramp extending from said recess end walls to the perimeter of said button, said walls of each recess intersecting to define a single interior corner of the recess and extending outwardly from said corner to the perimeter of said button to define an open recess extending along said button perimeter between the outer ends of said walls, the recess opening in both said one endwise direction of said axis and laterally of said axis, said recess thus defined maintaining itself clean and debris-free under the action of vehicle airstreams, wind and rain, light reflectors mounted in said recess end walls for reflecting light from headlights of approaching vehicles, and the two ramps formed by said recesses merging at their inner ends and rising above said reflectors, whereby vehicle wheeled tires rolling over said pavement marker ride along said ramps to the crest substantially midway of the button without contacting said reflectors.

6. A pavement marker according to claim 5 wherein: said ramps slope downwardly toward the perimeter of said button.

7. A pavement marker according to claim 6 wherein: said marker button has a disc shape and a convex upper surface with a crest at the merging inner ends of said ramps.

8. A pavement marker according to claim 7 wherein: said reflectors comprise circular reflector buttons secured to said recess end walls.

* * * * *